US012728328B2

(12) United States Patent
Armani

(10) Patent No.: US 12,728,328 B2
(45) Date of Patent: Sep. 8, 2026

(54) RACKET MASS DISPLACEMENT DEVICE FOR SPORTS PRACTICE

(71) Applicant: Marcos Armani, São Paulo (BR)

(72) Inventor: Marcos Armani, São Paulo (BR)

( * ) Notice: Subject to any disclaimer, the term of this patent is extended or adjusted under 35 U.S.C. 154(b) by 439 days.

(21) Appl. No.: 18/524,800

(22) Filed: Nov. 30, 2023

(65) Prior Publication Data

US 2025/0177830 A1 Jun. 5, 2025

(51) Int. Cl.
*A63B 60/04* (2015.01)
*A63B 60/02* (2015.01)
*A63B 60/24* (2015.01)

(52) U.S. Cl.
CPC ..... *A63B 60/04* (2015.10); *A63B 60/02* (2015.10); *A63B 60/24* (2015.10)

(58) Field of Classification Search
CPC ..... A63B 60/02; A63B 60/04; A63B 60/24
See application file for complete search history.

(56) References Cited

U.S. PATENT DOCUMENTS

2002/0032086 A1* 3/2002 Li ..... A63B 60/06 473/516

FOREIGN PATENT DOCUMENTS

CN 108771842 A * 11/2018 ..... A63B 60/02
KR 100654853 B1 * 12/2006 ..... A63B 53/0487

* cited by examiner

*Primary Examiner* — Audrey B. Walter
(74) *Attorney, Agent, or Firm* — FisherBroyles, LLP; Roger L. Browdy; James E. Mrose

(57) ABSTRACT

A racket mass displacement device for sports practice, with a protruding head (14) that can generate friction with the user's hands/fingers, a hollow main tube (1) fixed by glue or other adhesive means inside the racket handle (2), this hollow main tube (1) having a threaded cap (5), and a central rod (10) with an infinite thread (17), upon which a counter-weight moves.

4 Claims, 3 Drawing Sheets

FIG. 01
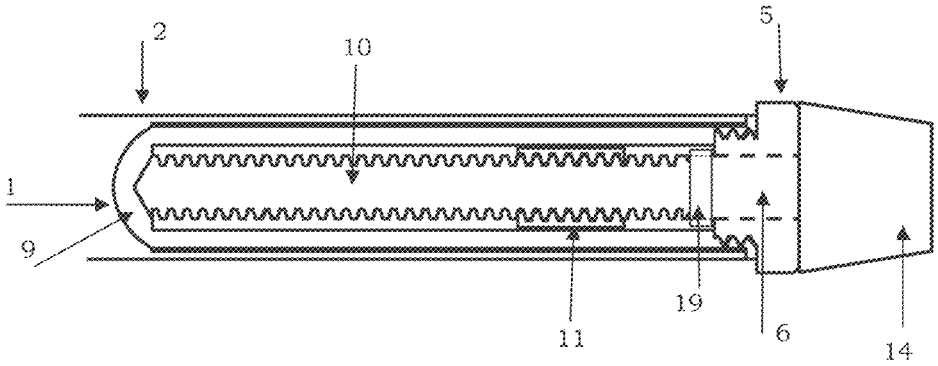
FIG. 02
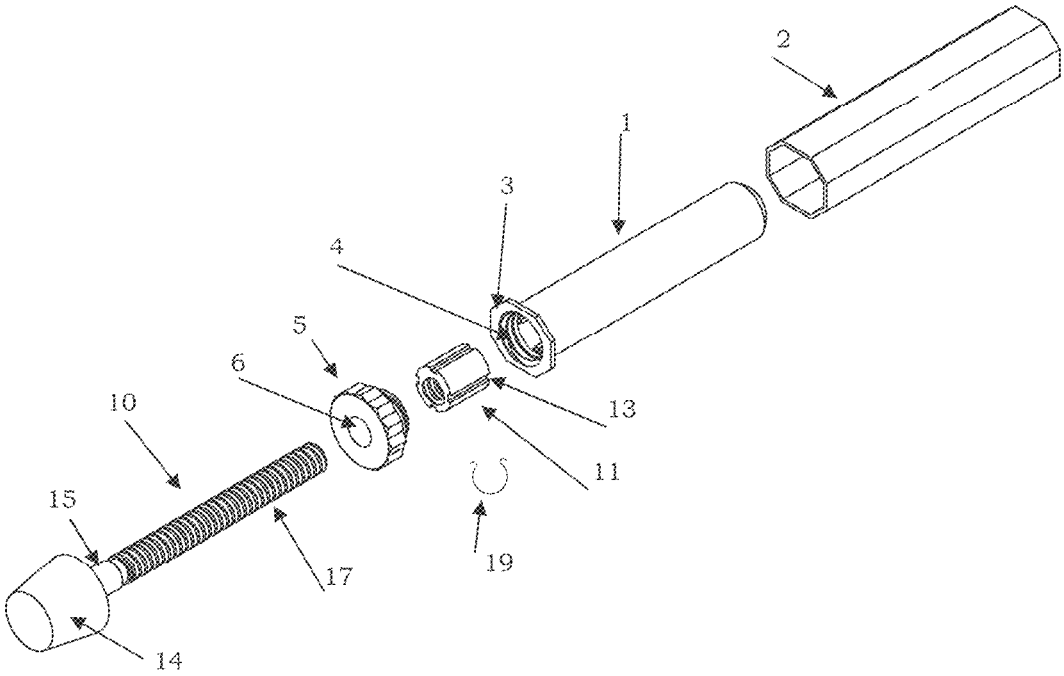
FIG. 3.A
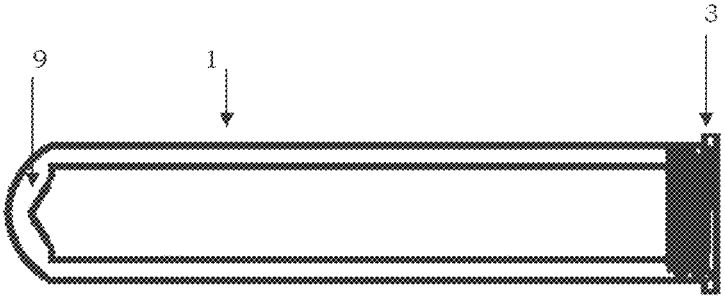

FIG. 03.B
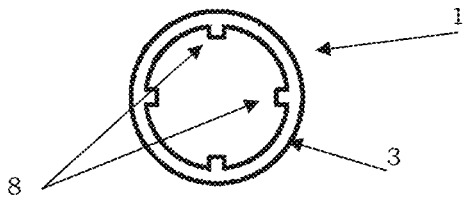
FIG. 04
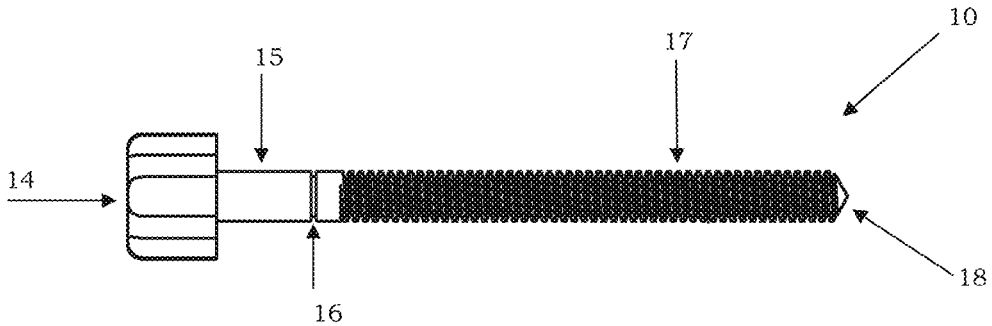
FIG. 05
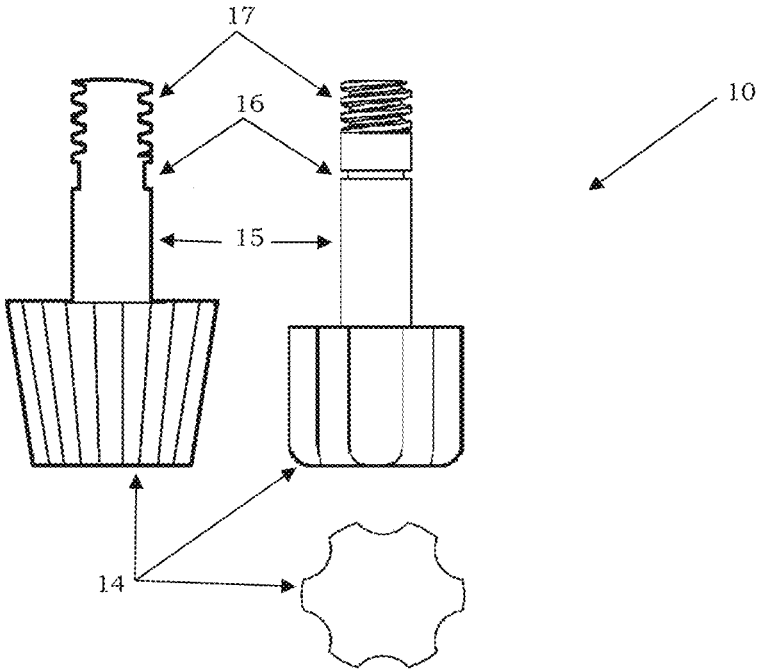

RACKET MASS DISPLACEMENT DEVICE FOR SPORTS PRACTICE

TECHNICAL FIELD

This descriptive report concerns an patent application for a mass displacement device applied to a racket for sports practice in a racket for sports practice.

STATE OF THE TECHNIQUE

Many sports require the use of rackets for their practice, and the user seeks to use a racket that enhances their game and is easy to handle.

Sports rackets are manufactured from a graphite module, or carbon fiber or fiberglass, or Kevlar (para-aramid synthetic fiber, very resistant to heat), or even made of 100% 3K carbon with the new high-density soft EVA, with characteristics appropriate to each type of sport, with more holes or fewer holes in the body of the racket.

There are rackets for sports practice with a technological device on the sides of the handle, which allows for a consistent reduction in the vibrations caused by the continuous impact of the ball, mitigating the player's wrist, elbow and shoulder.

Users can also change the string pressure, on rackets that have strings, in order to maximize their hits the ball, increasing or decreasing the speed of the ball.

The weight of the racket and the destruction of this weight also has an influence on the user's performance, since the balance of the is fundamental to the dynamics of the game.

As rackets are manufactured in a standardized way, the user cannot buy a specific racket that is already adapted to their playing pattern.

The user then makes adaptations to the racket in order to optimize their performance during play.

These adaptations are made to make the racket lighter or heavier, and are made by adding strips of lead to the head of the racket, or to its sides, or even across the heart of the racket.

The application of extra weight to the racket seeks to find the best balance between the speed of spin and the weight of the racket, optimizing the player's performance during the match. However, this practice is empirical and does not allow the user to recalibrate the racket's balance throughout the match, as the weights are glued to the body of the racket, making it difficult to remove and/or difficult to remove and/or adjust their positioning.

The U.S. Pat. No. 4,179,121 teaches the construction of a round tube inside the racket, from the base, circulating through the entire "head" of the racket, this tube being divided into two chambers by valves. The lower chamber contains mercury or another very dense liquid. The lower chamber communicates with the upper chamber via valves, whereby centrifugal force and gravity, the liquid is directed between the two chambers, increasing the kinetic force kinetic force exerted against the ball, providing a more powerful swing and improved play swing and improved play. This procedure also does not ensure better performance for the user, who does not have the option of calibrating the valves for the passage of liquid inside the racket, altering its balance. In addition, the racket has to be manufactured with the tube inside, which restricts the user's options, not be able to choose their preferred racket model from the market.

OBJECTIVES AND ADVANTAGES OF THE INVENTION

In order to solve the problem of racket balance and to allow the user to quickly make precise the user to quickly make precise adjustments while using his racket, the Applicant has developed a mass displacement device to rackets of any sporting discipline, which is inserted into the handle of the racket, constituting an integrated system, which allows the racket's balance point to be adjusted, providing the user with the best arrangement according to their convenience, before or during the match.

It consists of a main tube, which is housed inside the handle, according to the size and type of racket. This tube is fitted with internal guides, through which a counterweight slides, fitted with symmetrical grooves open longitudinally on its external side and, in its center, fitted with a through hole, with an infinite thread, also longitudinally, through which the central rod passes, and the central rod, when driven in rotational movements, causes the counterweight to move longitudinally throughout the internal length of the main tube, causing the racket's balance point to change.

This central rod is activated by the user at any time, before or during the match, via the protruding head on its upper part, thus forming a system for altering the racket's balance point towards the tip or its handle, allowing the user to change the way they play from soft to consistent or aggressive and vice versa.

The central shaft has a small smooth upper part and the rest has an infinite thread, to which is attached a counterweight with an infinite internal thread is attached, to the inner wall of the main pipe, through symmetrical longitudinal guides.

The upper part of the central stem is provided with a protruding head with grooves, hexagonal, or in another arrangement that can generate friction with the user's hands/fingers, which will promote the rotational movement of the rod on its axis.

By turning the protruding head of the central stem either clockwise or anti-clockwise, the user rotates the central stem on its axis and, consequently, makes the counterweight, which is attached to the internal symmetrical guides of the main tube, move longitudinally inside the main tube.

By moving the counterweight through the main pipe, making the counterweight move internally along the entire length of the racket handle, the user the user quickly and easily chooses the best balance point to play their game to play their game.

As the counterweight is attached to the main tube's internal symmetrical guides, it remains immobilized inside the handle main tube, remains immobilized inside the racket handle, until the user moves it, changing the balance of the racket, in any way desired.

The purpose of the present patent is to integrate rackets for sporting rackets with a mass displacement device, in any sport that uses rackets, which can be easily adjusted by the user.

DESCRIPTION OF THE FIGURES

To complement this description in order to obtain a better understanding of the characteristics of the racket mass device and in accordance with a preferred practical use of the device, a set of drawings is attached to the description, set of drawings in which, in an exemplary but not limiting way, the following the following has been shown:

FIG. 1 shows a side view of the main tube mounted inside the racket handle inside the racket handle;

FIG. 2 shows a side view of all the parts of the in line;

FIG. 3.A represents an internal side view of the main tube with the concave receptacle;

FIG. 3.B shows a top view of the main tube with the internal symmetrical guides and flap;

FIG. 4 shows a side view of the central stem;

FIG. 5 shows a side view of the upper part of the stem center;

DETAILED DESCRIPTION OF THE OBJECT

Figure 6:
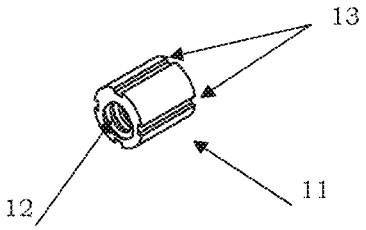
FIG. 6 shows a side view of the counterweight.
Figure 7:
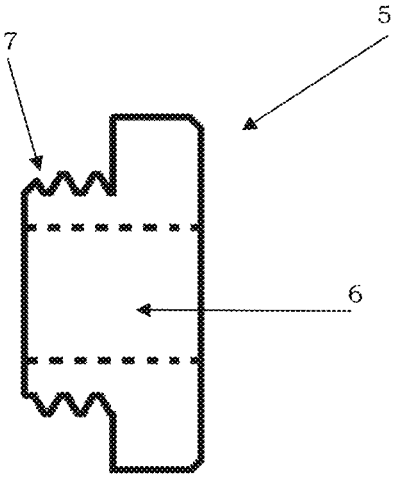
FIG. 07 shows a side view of the cover.

With reference to the illustrated drawings, the present privilege refers to a "MASS DISPLACEMENT DEVICE FOR A SPORTING RACKET", more precisely, it is a device used to balance the weight of a sporting racket (2) and shift its balance, with the aim of improve the user's performance.

Said device comprises a hollow main tube (1), which is fixed by glue or any other adhesive means to the inside of the racket handle (2), a support flap (3) and internal thread (4) in its upper part, symmetrical guides (8) in high relief on its internal wall and, in its lower internal part, a centralized concave receptacle (9) for conditioning and fitting the central rod (10).

The central stem (10) is composed, in its upper part, of a protruding head (14) with external grooves, hexagonal, or in another arrangement that can generate friction with the user's hands/fingers, and the body of said central rod (10) has a small smooth upper part (15), followed by a channel (16) in low relief all around its circumference and the rest of its body has an infinite thread (17), through which the counterweight (11) with infinite internal thread (12) will move. (12), with the lower part of the central stem (10) having a convex (18), so that it can be fitted into the concave receptacle (9) on the inside bottom of the main tube (1), eliminating the possibility of lateral movement of the central rod (10).

The counterweight (11), which moves along the entire length of the central stem rod (10) is equipped with an infinite internal thread (12) and symmetrical grooves. (13) on its external side, with these symmetrical grooves (13) being symmetrical grooves (13) are fitted into the symmetrical guides (8) in high relief on the inside of the main inside the main tube (1).

In order to immobilize the central rod (10) in the main tube (1), there is a cap (5) is provided, fixed or fitted with an external thread (7), which will be fixed or threaded onto the internal thread (4) at the top of the main pipe (1), with this cover (5) having a central hollow hole (6) with a smooth interior. (6) with a smooth interior, through which the central rod (10) will be inserted, so that the small upper part (15) of the central rod (10) fits into the fits into the central hollow hole (6) of said cover (5), and the central rod (10) is attached to the cover (5) by means of a clip (19), inserted into the low relief channel (16) on the central rod (10), so as not to allow vertical or so as not to allow vertical or lateral movement of the central rod (10) central stem (10) and leaving the part of the central stem (10) with an infinite thread (17) free for movement thread (17) free for rotational movements on its axis.

The main tube (1) is inserted inside the racket handle (2), and is fixed by glue or any other adhesive means.

The central rod (10) is inserted through the central hollow hole (6) in the cover (5), and is fixed to this cover (5) by a clip (19) inserted in the channel (16) in low relief existing in said central rod (10), the counterweight (11) being threaded into the part of the central stem (10) with an infinite thread (17), and this assembly is inserted into the main tube (1), up to the lower convex part (18) of the central rod. convex shape (18) of the central stem (10) is accommodated in the concave receptacle (9) on the inside bottom of the main tube (1), and the external symmetrical grooves (13) in low relief on said counterweight (11) fit into the symmetrical guides (8) on the inner wall of the main pipe on the inner wall of the main tube (1), with the device being installation of the device on the racket is completed, with the screwing or fixing the cover (5) on the main tube (1), immobilizing the set and only allowing the central rod (10) to rotate on its axis, either clockwise or counterclockwise axis, both clockwise and anticlockwise.

With the device attached to the racket (2), the user, through the protruding head (14) of the central rod (10), can make rotational movements rotation of the central rod (10), in a clockwise or anti-clockwise direction, in order to clockwise or anti-clockwise, in order to move the counterweight (11) along the entire length of the part of the central rod (10) fitted with an infinite thread (17), controlling the desired balance point for your racket (2).

The present racket mass displacement device (2) for sports practice can be modified in terms of construction, dimensioning, materials, functional configurations, relating to process steps and parameters, without falling outside the scope of protection of the privilege.

The invention claimed is:

1. A mass displacement device in a racket for sports comprising:

a racket handle;

a hollow main tube fixed by glue or other adhesive means to an inside of the racket handle, the main tube comprising:

an external support flap and an internal thread at a first end;

internal symmetrical guides formed along the entire length of the main tube and protruding from an inner wall; and a centralized concave receptacle at a second end;

a cover having an external thread and a central hollow hole;

a counterweight having an infinite internal thread and symmetrical grooves, a central stem passing through the central hollow hole of the cover and fixed to the cover by means of a clip, the central stem comprising:

a protruding head at a first end;

a smooth upper part adjacent to the protruding head;

a channel around an entire circumference adjacent to the smooth upper part;

a body with an infinite thread; and a convex part at a second end.

2. The mass displacement device in a racket for sports according to claim 1, wherein the symmetrical grooves are located on an outside of the counterweight.

3. The mass displacement device in a racket for sports according to claim 1, wherein the external thread of the cover is threaded into the internal thread of the main tube, and the central hole has a smooth interior through which the central stem passes through.

4. The mass displacement device in a racket for sports according to claim 1, wherein the central stem passes through the central hole in the cover and is fixed to the cover by the clip inserted into the channel of the central stem;

the counterweight is threaded onto the infinite thread of the central stem;

the central stem, cover, and counterweight are inserted into the main tube such that the external thread of the cover is threaded into the internal thread of the main tube until the convex part of the central stem fits into the concave receptacle of the main tube; and the symmetrical grooves of the counterweight fit into the symmetrical guides of the main tube.

* * * * *